US009522310B2

(12) United States Patent
Abe

(10) Patent No.: US 9,522,310 B2
(45) Date of Patent: Dec. 20, 2016

(54) GOLF CLUB HEAD

(71) Applicant: Dunlop Sports Co. Ltd., Kobe-shi, Hyogo (JP)

(72) Inventor: Hiroshi Abe, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 135 days.

(21) Appl. No.: 14/453,730

(22) Filed: Aug. 7, 2014

(65) Prior Publication Data

US 2015/0045147 A1 Feb. 12, 2015

(30) Foreign Application Priority Data

Aug. 8, 2013 (JP) ..... 2013-165482

(51) Int. Cl.
*A63B 53/04* (2015.01)

(52) U.S. Cl.
CPC ..... *A63B 53/04* (2013.01); *A63B 53/0466* (2013.01); *A63B 60/52* (2015.10); *A63B 2053/0408* (2013.01); *A63B 2053/0437* (2013.01); *A63B 2053/0458* (2013.01)

(58) Field of Classification Search
CPC ..... A63B 53/04; A63B 2053/0408; A63B 2053/0458; A63B 53/0466; A63B 60/52; A63B 2053/0437
USPC ..... 473/324–350, 287–292
See application file for complete search history.

(56) References Cited

U.S. PATENT DOCUMENTS 2,859,972 A * 11/1958 Reach ..... A63B 53/04 473/242
3,997,170 A * 12/1976 Goldberg ..... A63B 53/04 473/327
5,921,872 A * 7/1999 Kobayashi ..... A63B 53/04 473/345
6,783,465 B2 * 8/2004 Matsunaga ..... A63B 53/0466 473/329
7,157,830 B2 * 1/2007 Jansson ..... H02N 2/0015 310/317
7,303,488 B2 * 12/2007 Kakiuchi ..... A63B 53/0466 473/345
7,377,861 B2 * 5/2008 Tateno ..... A63B 53/0466 473/345
7,445,564 B2 * 11/2008 Kusumoto ..... A63B 53/0466 473/345
7,448,964 B2 * 11/2008 Schweigert ..... A63B 53/0466 473/345

(Continued)

FOREIGN PATENT DOCUMENTS

JP 2005-312942 * 3/2005 ..... A63B 53/04
JP 5142486 B2 2/2013

*Primary Examiner* — Sebastiano Passaniti
(74) *Attorney, Agent, or Firm* — Birch, Stewart, Kolasch & Birch, LLP

(57) ABSTRACT

A hollow golf club head has a crown portion extending from a face portion and configured so as to generate good ball hitting sound. The crown portion is provided with a first region having a first thickness, a second region having a second thickness and a third region having a third thickness, wherein the third thickness is less than the second thickness which is less than the first thickness. The first region is disposed in a face portion side of the crown portion and extending in the toe-heel direction. The third region is disposed backward of the first region. The second region surrounds the third region.

9 Claims, 10 Drawing Sheets

(56) References Cited

U.S. PATENT DOCUMENTS

| | | | | |
|---|---|---|---|---|
| 7,455,597 | B2 * | 11/2008 | Matsunaga | A63B 53/0466 473/329 |
| 7,503,853 | B2 * | 3/2009 | Matsunaga | A63B 53/0466 473/329 |
| 7,828,669 | B1 * | 11/2010 | Stites | A63B 53/0466 473/219 |
| 8,172,697 | B2 * | 5/2012 | Cackett | A63B 53/0466 473/329 |
| 8,308,582 | B2 * | 11/2012 | Tanimoto | A63B 53/0466 473/335 |
| 8,414,421 | B2 * | 4/2013 | Jertson | A63B 53/0466 473/332 |
| 9,174,100 | B2 * | 11/2015 | Takechi | A63B 53/0466 |
| 2004/0053705 | A1 * | 3/2004 | Kumamoto | A63B 53/0466 473/345 |
| 2005/0159245 | A1 * | 7/2005 | Chen | A63B 53/0466 473/345 |
| 2006/0014592 | A1 * | 1/2006 | Sugimoto | A63B 53/0466 473/345 |
| 2007/0129167 | A1 * | 6/2007 | Matsunaga | A63B 53/0466 473/345 |
| 2012/0021849 | A1 * | 1/2012 | Gibbs | A63B 53/0466 473/342 |
| 2014/0213389 | A1 * | 7/2014 | Yamamoto | A63B 53/0466 473/345 |
| 2015/0072803 | A1 * | 3/2015 | Golden | A63B 53/04 473/345 |
| 2015/0238827 | A1 * | 8/2015 | Nakamura | A63B 53/0466 473/345 |

* cited by examiner

E1 cross section

GOLF CLUB HEAD

BACKGROUND OF THE INVENTION

The present invention relates to a golf club head, more particularly to a structure of the crown portion capable of generating good ball hitting sound.

Japanese Patent No. 5142486 discloses a hollow golf club head whose crown portion has a smaller thickness in its front region than in the rear region. Thereby, the front region can deflect when hitting a ball, and the launch angle of the ball can be increased.

In this golf club head, the ball hitting sound is unconsidered, and there is room for improvement.

SUMMARY OF THE INVENTION

It is an object of the present invention to provide a golf club head capable of generating good ball hitting sound.

According to the present invention, a golf club head with a hollow therein comprises:

a face portion having a club face for hitting a ball, and a crown portion extending from the face portion to form a top surface of the club head, the crown portion comprising a first region having a first thickness, a second region having a second thickness less than the first thickness, and a third region having a third thickness less than the second thickness, wherein the first region is disposed in a face portion side of the crown portion and extends in the toe-heel direction, the third region is disposed backward of the first region, and the second region surrounds the third region.

The golf club head according to the present invention may have the following features (1)-(12):

(1) the crown portion is provided with only one third region;

(2) the crown portion is provided with a plurality of the third regions;

(3) the crown portion is provided with a plurality of the third regions which are a most toe-side third region, a most heel-side third region, and at least one in-between third region therebetween in the toe-heel direction;

(4) when measured in the top view of the golf club head under its standard state, the area of the first region is 8% to 30% of an area of the crown portion;

(5) when measured in the top view of the golf club head under its standard state, the area of the second region is 40% to 80% of the area of the crown portion;

(6) when measured in the top view of the golf club head under its standard state, the area of the third region is 10% to 25% of the area of the crown portion;

(7) the first thickness is 0.6 to 1.7 mm, the second thickness is 0.5 to 0.9 mm and the third thickness is 0.3 to 0.6 mm;

(8) the first thickness is constant, the second thickness is constant, and a 1st transitional zone of which thickness is gradually decreased from the first region to the second region is formed between the first region and the second region;

(9) the second thickness is constant, the third thickness is constant, and a 2nd transitional zone of which thickness is gradually decreased from the second region to the third region is formed between the second region and the third region.

(10) a plurality of the third regions are disposed, and in the top view of the club head under its standard state, the third regions extend along respective directions radiating from the vicinity of the center of gravity of the head while gradually increasing their widths measured perpendicularly to the respective radiating directions;

(11) a plurality of the third regions are disposed, and in the top view of the club head under its standard state, the third regions extend along respective directions radiating from the vicinity of the face portion while gradually increasing their widths measured perpendicularly to the respective radial directions;

(12) a plurality of the third regions are arranged in the front-back direction of the head, and in the top view of the club head under its standard state, the areas of the third regions are gradually increased from the front side to the rear side of the head.

Therefore, when a large impactive force is applied to the first region near the face portion by hitting a ball, the first region having a higher rigidity vibrates at a higher frequency with a smaller amplitude and generates a high-pitched ball hitting sound, and the third region having a smaller thickness and a lower rigidity vibrates at a lower frequency with a larger amplitude and generates a low-pitched ball hitting sound. Further, the second region vibrates at a middle frequency with a middle amplitude and generates a middle-pitched ball hitting sound. Thus, the vibration when hitting a ball is transmitted from the first region to the third region through the second region surrounding the third region, namely, from the first region vibrating with a smaller amplitude to the third region. Therefore, the generation of a low-pitched loud ball hitting sound from the third region can be prevented.

Further, the sound synthesized from the vibration sounds of the first region, the second region and the third region is recognized by the human ear as having a reverberant sound with a preferable decay time.

Therefore, the golf club head according to the present invention can generate good ball hitting sound synthesized from at least three different vibration sounds generated by the first region, the second region and the third region.

Incidentally, it is preferable that the frequency spectrum of the ball hitting sound has a distinctive peak or peaks in a range of from about 3500 Hz to about 4500 Hz.

In this application including the description and claims, dimensions, positions, directions and the like relating to the club head refer to those under a standard state of the club head unless otherwise noted.

Here, the standard state of the club head is such that the club head is set on a horizontal plane HP so that the axis CL of the club shaft (not shown) is inclined at the specified lie angle alpha while keeping the axis on a vertical plane VP, and the face forms the specified loft angle with respect to the horizontal plane HP. Incidentally, in the case of the club head alone, the center line CL of the shaft inserting hole can be used instead of the axis of the club shaft.

"Front-back direction" is a direction FR parallel with a straight line N projected on the horizontal plane HP, wherein the straight line N is drawn normally to the face 2*a* passing through the center G of gravity of the club head.

"Toe-heel direction" is a direction TH parallel with the horizontal plane HP and perpendicular to the front-back direction FR.

"Sweet spot SS" is the point of intersection between the club face and the straight line N drawn normally to the club face passing the center G of gravity of the head.

DESCRIPTION OF THE PREFERRED EMBODIMENTS

Figure 1:
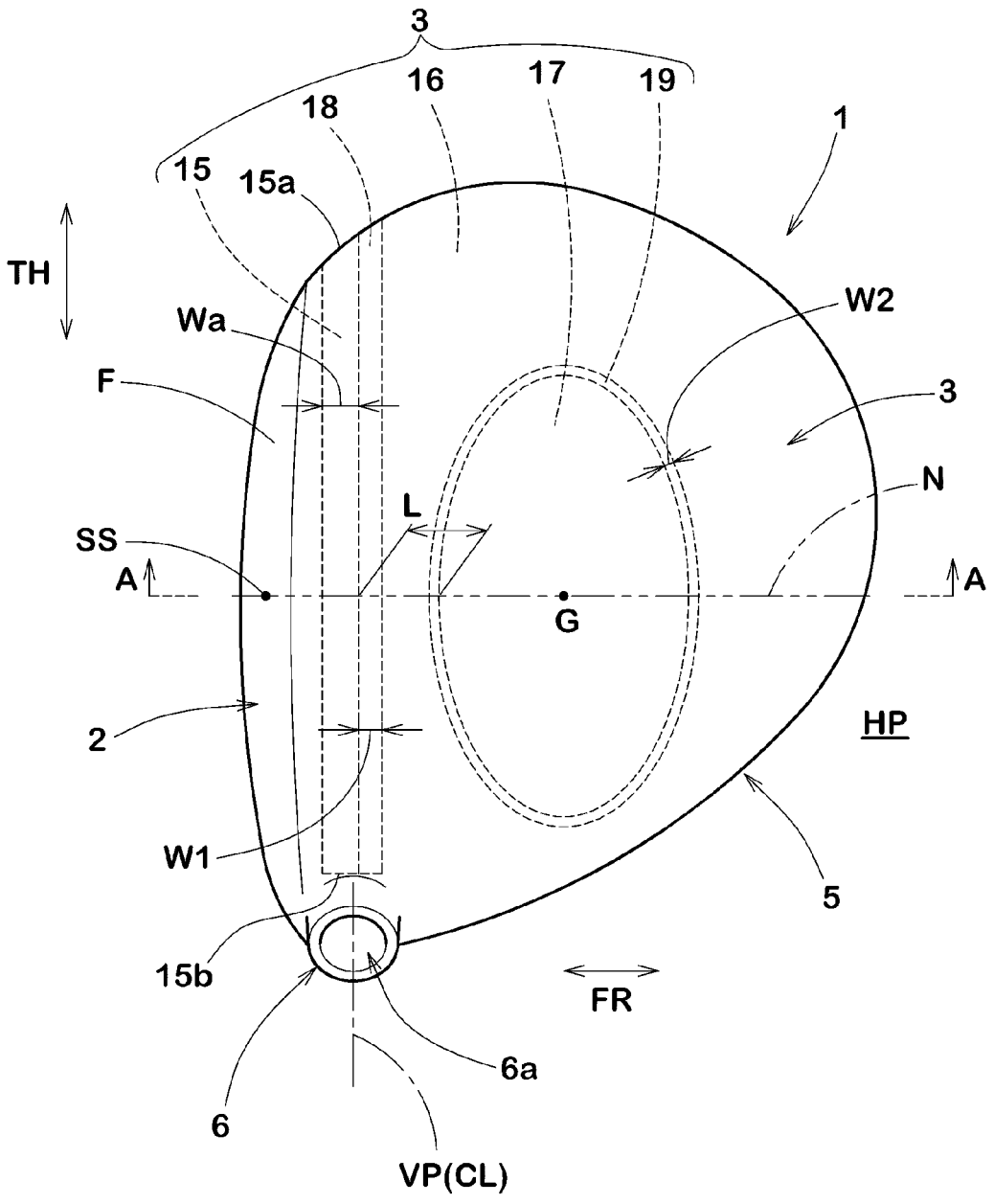
FIG. 1 is a plan view a golf club head as an embodiment of the present invention.

Embodiments of present invention will now be described in detail in conjunction with accompanying drawings. Throughout all of the embodiments, same members or portions are denoted by the same reference signs.

In the following embodiments, each club head 1 is for a wood-type club.

The term "wood-type club" is meant for at least driver (#1 wood), and fairway woods such as brassie (#2 wood), spoon (#3 wood), baffy (#4 wood) and cleek (#5 wood) are included. In addition, club heads having similar shapes to those wood-type club heads are included even if the number or name of the club is different from the above.

The club head 1 may be constructed for a utility club in another embodiment of the present invention.

The club head 1 is, for example, made of one or more kinds of metal materials, e.g. stainless steel alloy, maraging steel, titanium, titanium alloy, magnesium alloy, aluminum alloy and the like.

The club head 1 comprises a face portion 2, a crown portion 3, a sole portion 4 and a side portion 5. The club head 1 has a hollow (i) therein.

The face portion 2 has a club face F for hitting a ball.

The crown portion 3 is continuous from the face portion 2 and forms a top surface of the club head.

The sole portion 4 is continuous from the face portion 2 and forms a bottom surface of the club head.

The side portion 5 extends between the crown portion 3 and the sole portion 4. The side portion 5 is connected to the face portion 2 on the toe-side and on the heel-side.

A hosel portion 6 is formed in a heel-side of the crown portion 3. The hosel portion 6 is tubular and provided with a shaft inserting hole 6*a* to be fixed to a golf club shaft (not shown).

Figure 3:
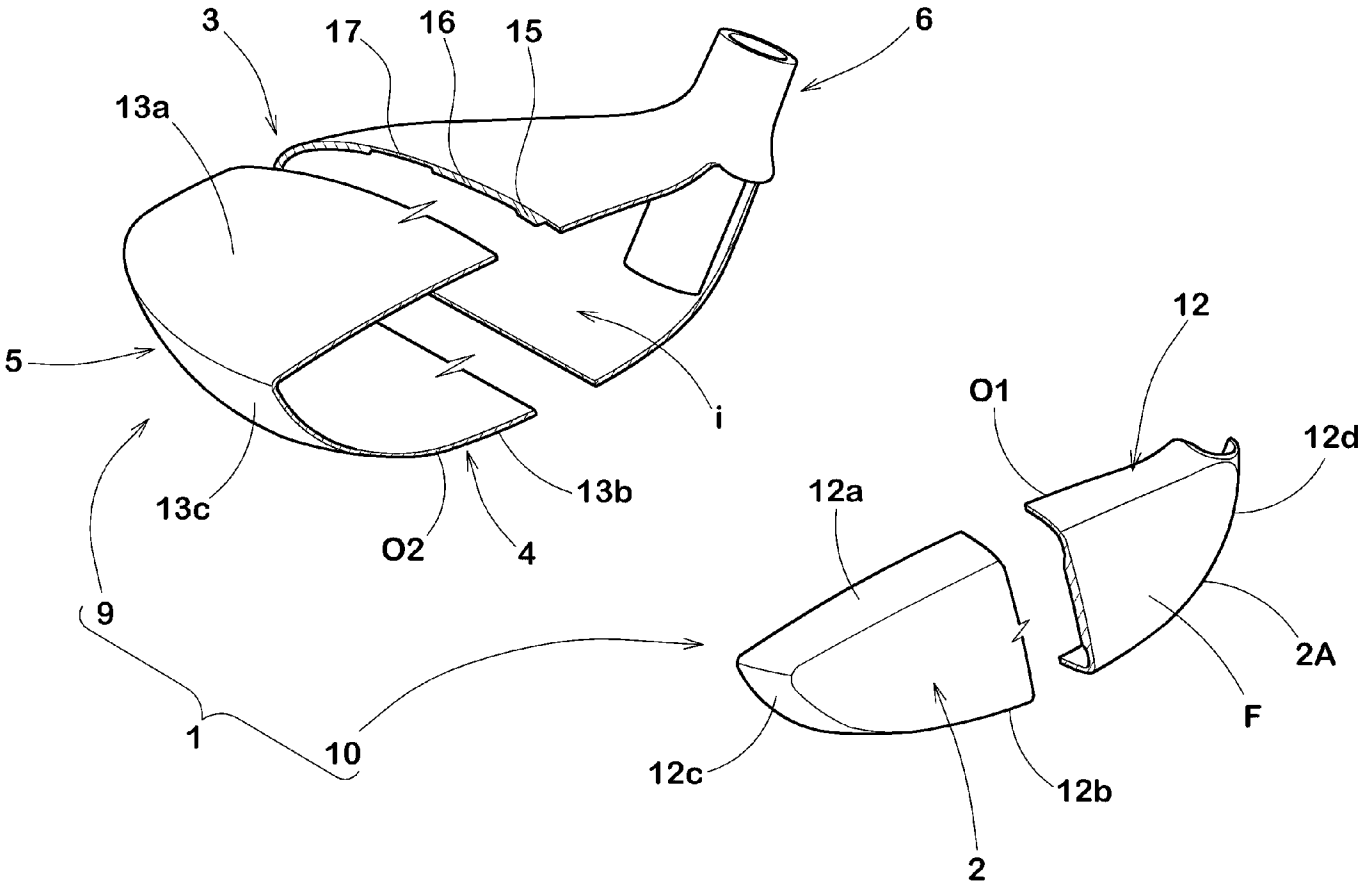
FIG. 3 is an exploded perspective view of the golf club head.

In this embodiment, as shown in FIG. 3, the club head 1 comprises a head main body member 9 and a face member 10. The face member 10 is to form a fore part of the club head 1. The face member 10 in this example is cup-shaped and includes the entirety of the face portion 2 and a turnback 12 extending backward of the club head from the peripheral edge 2A of the club face F. Thereby, the face member 10 has a cavity opened backward of the club head and has a rear edge O1 surrounding the opening.

The turnback 12 is formed substantially continuously around the opening and includes a crown-side turnback 12*a*, a sole-side turnback 12*b*, a toe-side turnback 12*c* and a heel-side turnback 12*d*.

The above-mentioned head main body member 9 includes the hosel portion 6, an aft major part 13*a* of the crown portion 3, an aft major part 13*b* of the sole portion 4, and an aft major part 13*c* of the side portion 5. Thereby, the head main body member 9 is also cup-shaped with a cavity opened forward of the club head and has a front edge O2 surrounding the opening.

The front edge O2 of the head main body member 9 is butted with the rear edge O1 of the face member 10, and they are fixed to each other, for example by welding.

The head main body member 9 and the face member 10 are not limited to such example. Various modifications are possible.

Figure 4:
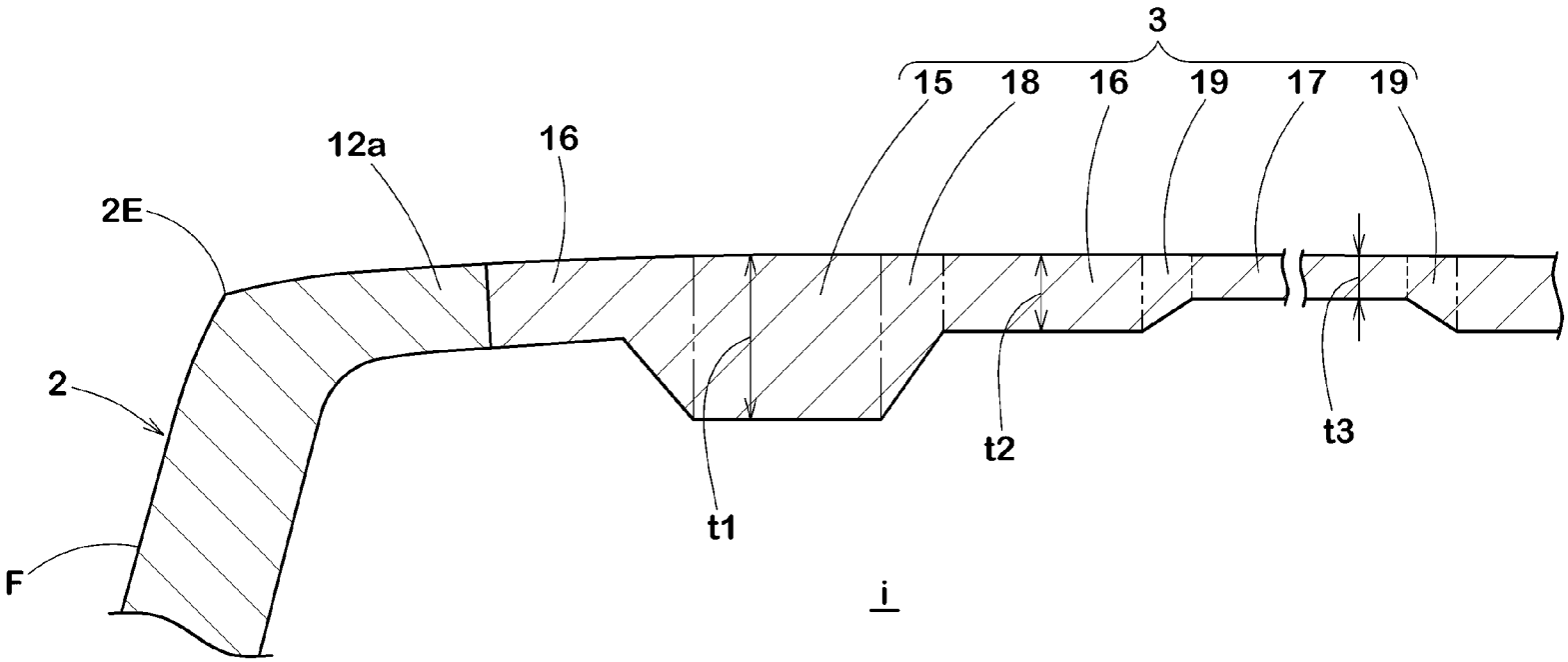
FIG. 4 is a cross sectional view taken along line A-A of FIG. 1.

As shown in FIG. 4, the crown portion 3 is provided with a first region 15 having a first thickness t1, a second region 16 having a second thickness t2 less than the first thickness t1, and a third region 17 having a third thickness t3 less than the second thickness t2. That is, t1>t2>t3.

In FIG. 4, the boundaries between the regions are indicated by imaginary line.

The inner surface of the crown portion 3 is a patterned indented surface whereas the outer surface thereof is smooth. As shown in FIG. 1 and FIG. 4, the first region 15 is disposed in a face portion 2 side of the crown portion 3 and extends in the toe-heel direction.

The third region 17 is disposed backward of the first region 15. The second region 16 is formed so as to surround the third region 17 in order that the first region 15 and the third region 17 are separated from each other.

When hitting a ball, a large impactive force is applied to the face portion 2 and transmitted to the first region 15 of the crown portion 3 positioned near the face portion 2. As a result, as the first region 15 has a relatively high rigidity in the crown portion 3, the first region 15 vibrates at a relatively high frequency with a small amplitude and generates a high-pitched small sound.

On the other hand, as the relatively thin third region 17 has relatively low rigidity, the third region 17 vibrates at a relatively low frequency with a larger amplitude and generates a low-pitched sound.

The second region 16 having the middle thickness t2 vibrates at a middle frequency with a medium amplitude and generates a middle-pitched sound.

As a result, the club head 1 of the present invention can generate good ball hitting sound synthesized from vibration sounds of the first region, the second region and the third region.

Preferably, the first region, the second region and the third region are configured so that the frequency spectrum of the ball hitting sound has a distinctive peak or peaks in a range of from about 3000 Hz to about 5000 Hz, more preferably in a range of from about 3500 Hz to about 4500 Hz.

Since the vibration when hitting a ball is propagated from the first region 15 to the third region through the second region 16, the reverberation time of the ball hitting sound can be adjusted by changing the length of the propagation path.

In this embodiment, the crown portion 3 is provided with only one first region 15. The first region 15 has a toe-side end 15*a* and a heel-side end 15*b*, and extends continuously therebetween. The longitudinal direction of the first region 15 coincides with the toe-heel direction. The toe-side end 15*a* is positioned at the toe-side end of the crown portion 3. The heel-side end 15*b* is positioned near the hosel portion 6. Thus, the first region 15 extends over the substantially entire width of the club face F, therefore, even if the ball hitting position is largely off centered, the vibration is steadily generated.

It is possible to form the first region 15 such that the first region 15 extends backwardly from the face portion 2. But, it is preferable that, as shown in FIG. 4, the first region 15 is disposed at a distance backwardly from the face portion 2 so that an additional second region 16 can be formed on the club face side of the first region 15.

By providing the additional second region 16 in such position, the durability of the crown portion 3 can be improved. Further, such arrangement can allow for the face portion 2 to deflect backwardly when hitting a ball.

If the first region 15 is distant backwardly from the club face F, it is difficult to obtain the vibration expectedly. Therefore, the first region 15 is preferably positioned such that the vertical plane VP including the axis CL of the club shaft is included within the width Wa in the front-back direction FR, of the first region 15 as shown in FIG. 1.

In this embodiment, the width Wa is substantially constant along the length of the first region 15.

But, it is also possible to vary the width Wa in the toe-heel direction. In such case, it is desirable that the width Wa is larger in the midportion of the club face F in the toe-heel direction, and smaller on the toe-side and the heel-side.

The first thickness t1 of the first region 15 is preferably set in a range of not less than 0.6 mm, more preferably not less than 0.7 mm, still more preferably not less than 0.9 mm, but not more than 1.7 mm, more preferably not more than 1.5 mm, still more preferably not more than 1.3 mm in order to maintain the durability of the crown portion 3 while achieving the improved ball hitting sound.

In this embodiment, the first thickness t1 is constant. But, the first thickness t1 may be varied within the above range.

The area A1 of the first region 15 is preferably set in a range of not less than 8%, more preferably not less than 10%, still more preferably not less than 12%, but not more than 30%, more preferably not more than 28%, still more preferably not more than 22% of an area Ac of the crown portion 3 in order to maintain the durability of the crown portion 3 while achieving the improved ball hitting sound.

Figure 5:
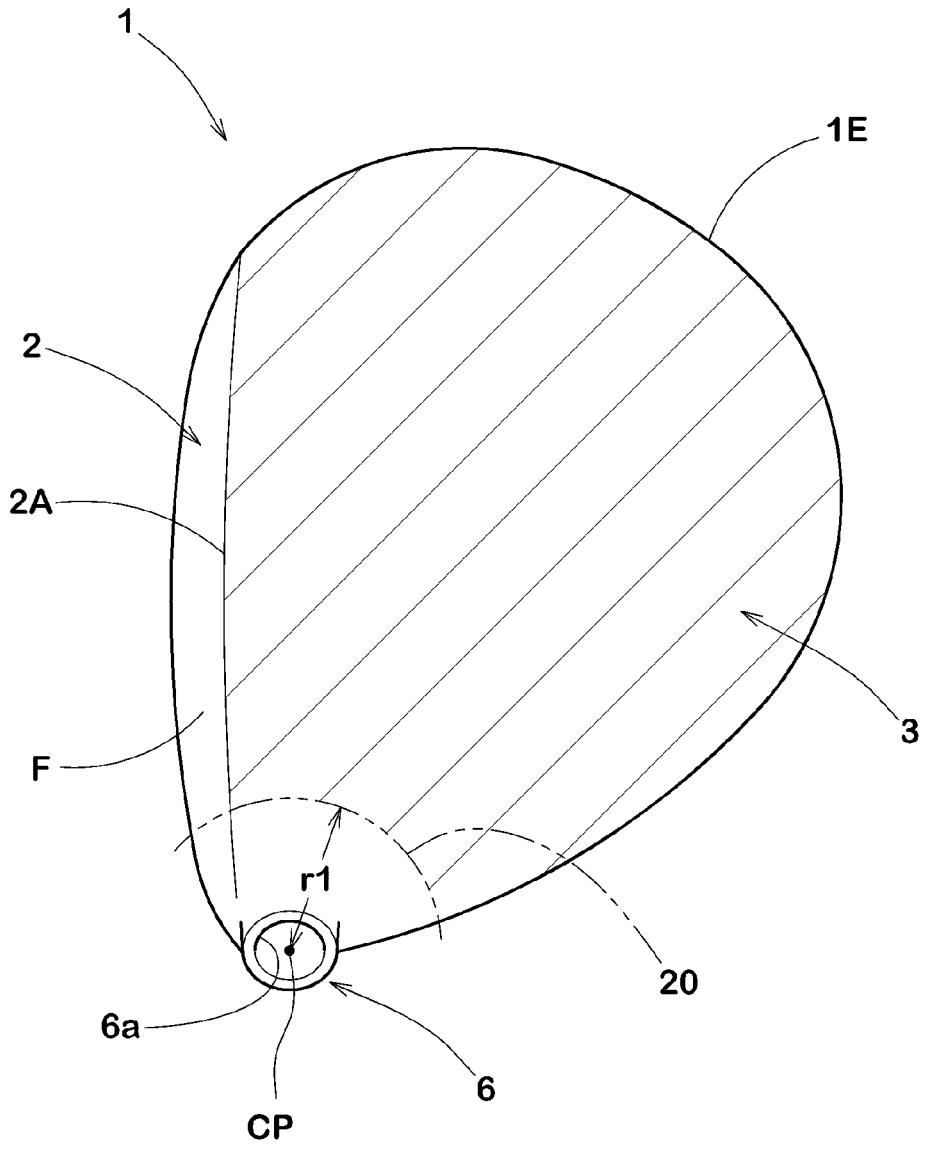
FIG. 5 is a plan view of the golf club head.

In the top view of the club head 1 under its standard state, the area Ac of the crown portion 3 is defined as the area surrounded by the peripheral edge 2A of the club face F of the face portion 2, the contour 1E of the club head 1 excluding the face portion 2, and a circular arc 20 having a radius r1 of 15 mm and centered on the center CP of the shaft inserting hole 6*a* of the hosel portion 6 as shown in FIG. 5 by hatching.

If the area A1 is less than 8% of the area Ac, the high-pitched sound generated from the first region 15 becomes small, and it is difficult to obtain comfortable high-pitched ball hitting sound. If the area A1 is more than 30% of the area Ac, there is a possibility that the rigid first region 15 becomes hard to vibrate and the high-pitched sound generated therefrom becomes insufficient.

Figure 6A:
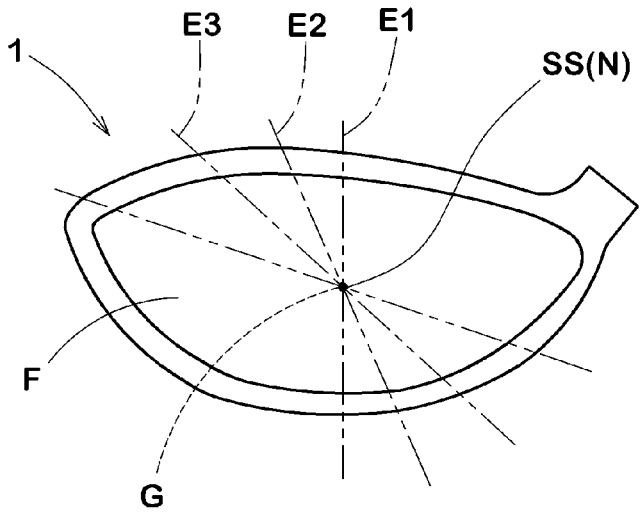
FIG. 6(*a*) and FIG. 6(*b*) are a front view of a golf club head and a cross sectional view of the face portion thereof for explaining the peripheral edge of the club face.
Figure 6B:
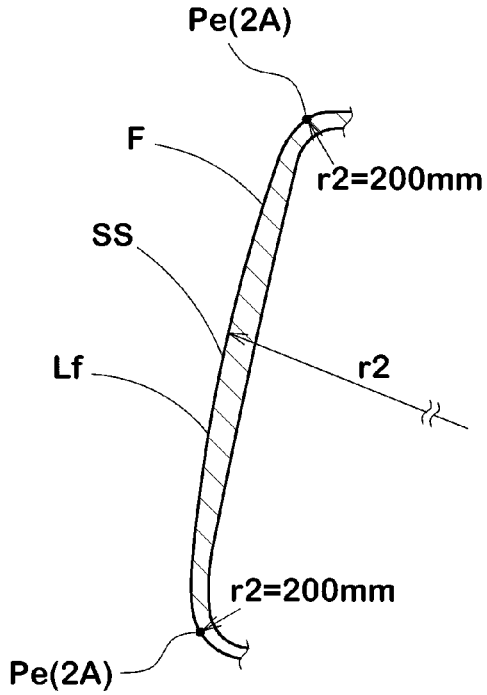

If the peripheral edge 2A of the club face F is unclear due to smooth change in the curvature, as shown in FIGS. 6(*a*) and 6(*b*), a virtual edge line (Pe) defined based on the curvature change is used instead as follows.

In each cutting plane E1, E2—including the sweet spot SS and the center G of gravity of the head, a point Pe at which the radius (r2) of curvature of the profile line Lf of the face portion first becomes under 200 mm in the course from the sweet spot SS to the periphery of the club face is determined. Then, the virtual edge line is defined as a locus of such points Pe.

It is preferable that the entirety of the contour of the third region 17 appears in the top view of the club head 1 under its standard state.

In this embodiment, the crown portion 3 is provided with only one third region 17 having an oval contour shape. Preferably, the oval has its major axis extending in the toe-heel direction. Such third region 17 is effectively vibrated to provide a reverberant sound even if the ball hitting position is off-centered toward the toe or heel.

Preferably, the third region 17 is arranged such that, in the top view of the club head 1 under its standard state, the third region 17 includes the center G of gravity of the head, namely, the center G is within the contour line of the third region 17.

In general, a position of the crown portion 3 which is in the vicinity of the center G of gravity of the head in the top view of the club head 1, is liable to largely vibrate. Therefore, arranging the thin third region 17 at such position makes is sure that the third region 17 generates the above-mentioned low-pitched sound constituting the good ball hitting sound.

Preferably, the third region 17 is disposed backward of the first region 15 such that the shortest distance L therebetween becomes in a range of from 5.0 to 20.0 mm in the top view of the club head 1 under its standard state.

If the shortest distance L is more than 20.0 mm, there is a possibility that the third region 17 is not effectively vibrated. If the shortest distance L less than 5.0 mm, there is a possibility that the durability of the crown portion 3 is deteriorated.

The third thickness t3 of the third region 17 is preferably set in a range of not less than 0.30 mm, more preferably not less than 0.35 mm, still more preferably not less than 0.40 mm, but not more than 0.60 mm, more preferably not more than 0.55 mm, still more preferably not more than 0.50 mm in order to maintain the durability of the crown portion 3 while achieving the improved ball hitting sound.

In this embodiment, the third thickness t3 is substantially constant. But, the third thickness t3 may be varied within the above range.

The area A3 of the third region 17 is preferably set in a range of not less than 10%, more preferably not less than 12%, still more preferably not less than 15%, but not more than 25%, more preferably not more than 23%, still more preferably not more than 20% of the area Ac of the crown portion 3 in order to maintain the durability of the crown portion 3 while achieving the improved ball hitting sound.

If the area A3 is less than 10% the area Ac, there is a possibility that the frequency of the sound generated from the third region 17 is increased, and the reverberant sound becomes insufficient. If the area A3 is more than 25% the area Ac, there is a possibility that the frequency of the sound generated from the third region 17 is decreased, and the reverberant sound becomes unfavorably increased.

The second region 16 forms a part of the crown portion 3 excluding the first region 15 and the third region 17 in substance. The second region 16 prevents a direct connection between the first region 15 and the third region 17 to prevent stress concentration in the crown portion 3 due to the difference between the thicknesses t1 and t3.

In this embodiment, the second region 16 extends continuously around the third region 17 to effectively propagate the vibration of the first region 15 when hitting a ball through the second region 16 to the entire periphery of the third region 17 so that the third region 17 effectively generates the above-mentioned sound.

For this reason, the second thickness t2 of the second region 16 is preferably set in a range of not less than 0.50 mm, more preferably not less than 0.55 mm, still more preferably not less than 0.60 mm, but not more than 0.90 mm, more preferably not more than 0.80 mm, still more preferably not more than 0.70 mm. In this embodiment, the second thickness t2 is substantially constant. But, the second thickness t2 may be varied within the above range.

Although the area A2 of the second region 16 is determined depending on the area A1 of the first region 15 and the area A3 of the third region 17, it is preferable that the area A2 is in a range of from 40% to 80% of the area Ac of the crown portion 3 to effectively derive the above-mentioned effects.

It is preferable that the crown portion 3 is provided with a 1st transitional zone 18 and a 2nd transitional zone 19 as shown in FIG. 1 and FIG. 4.

The 1st transitional zone 18 is formed between the first region 15 and the second region 16, and its thickness is gradually decreased from the first region 15 (first thickness t1) to the second region 16 (second thickness t2).

The 2nd transitional zone 19 is formed between the second region 16 and the third region 17, and its thickness is gradually decreased from the second region 16 (second thickness t2) to the third region 17 (third thickness t3).

Preferably, the width W1 of the 1st transitional zone 18 and the width W2 of the 2nd transitional zone 19, each measured perpendicularly to it length direction, is set in a range of 0.5 to 10.0 mm.

Such transitional zones 18 and 19 can facilitate the propagation of the vibration.

FIGS. 7-10 each show another embodiment of the present invention, wherein the club head 1 is provided in the crown portion 3 with a plurality of the third regions 17 separated from each other by the 2nd Region 16.

Figure 7:
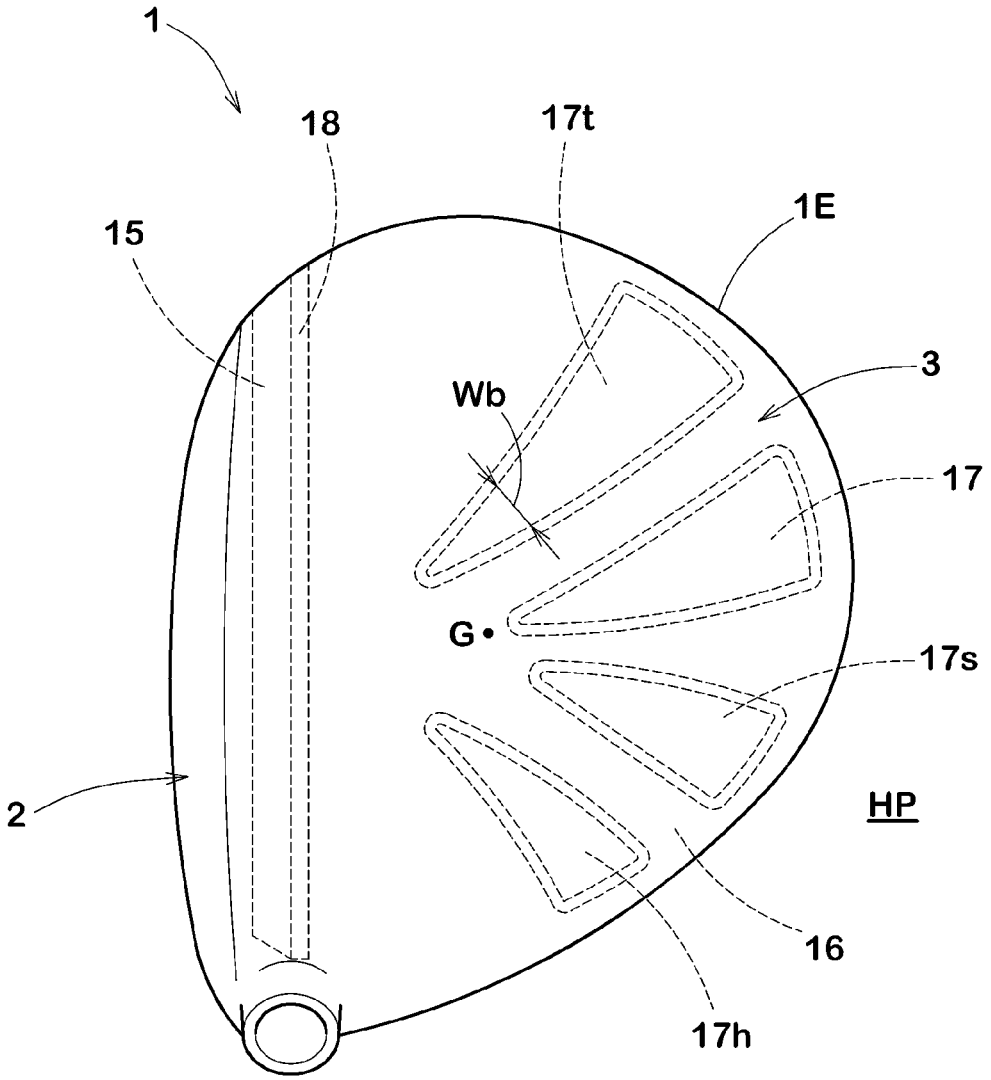
FIGS. 7-10 each show a plan view of a golf club head as another embodiment of the present invention.

In the embodiment shown in FIG. 7, the third regions 17 include the most toe-side third region 17*t*, the most heel-side third region 17*h*, and at least one in-between third region 17*s* therebetween (in this example two in-between third regions 17*c*). It is therefore possible to make the third regions 17 over a wide range in the toe-heel direction of the crown portion 3 without reducing the durability of the crown portion 3, and as a result, it is possible to increase the sound generated from the third regions 17 to control the ball hitting sound in particular the reverberant sound.

In the top view of the club head 1 under its standard state, the most toe-side third region 17*t*, the most heel-side third region 17*h* and the in-between third regions 17*s*, namely, all of the third regions 17 extend along respective directions radiating from the vicinity of the center G of gravity. In other words, all of the third regions 17 have their length directions in radial directions.

Preferably, the width Wb of each of the third regions 17*t*, 17*h* and 17*s* measured perpendicularly to the radial direction is gradually increased toward the radially outside. Such third regions 17 can generate a reverberant sound having a preferable decay time.

Figure 8:
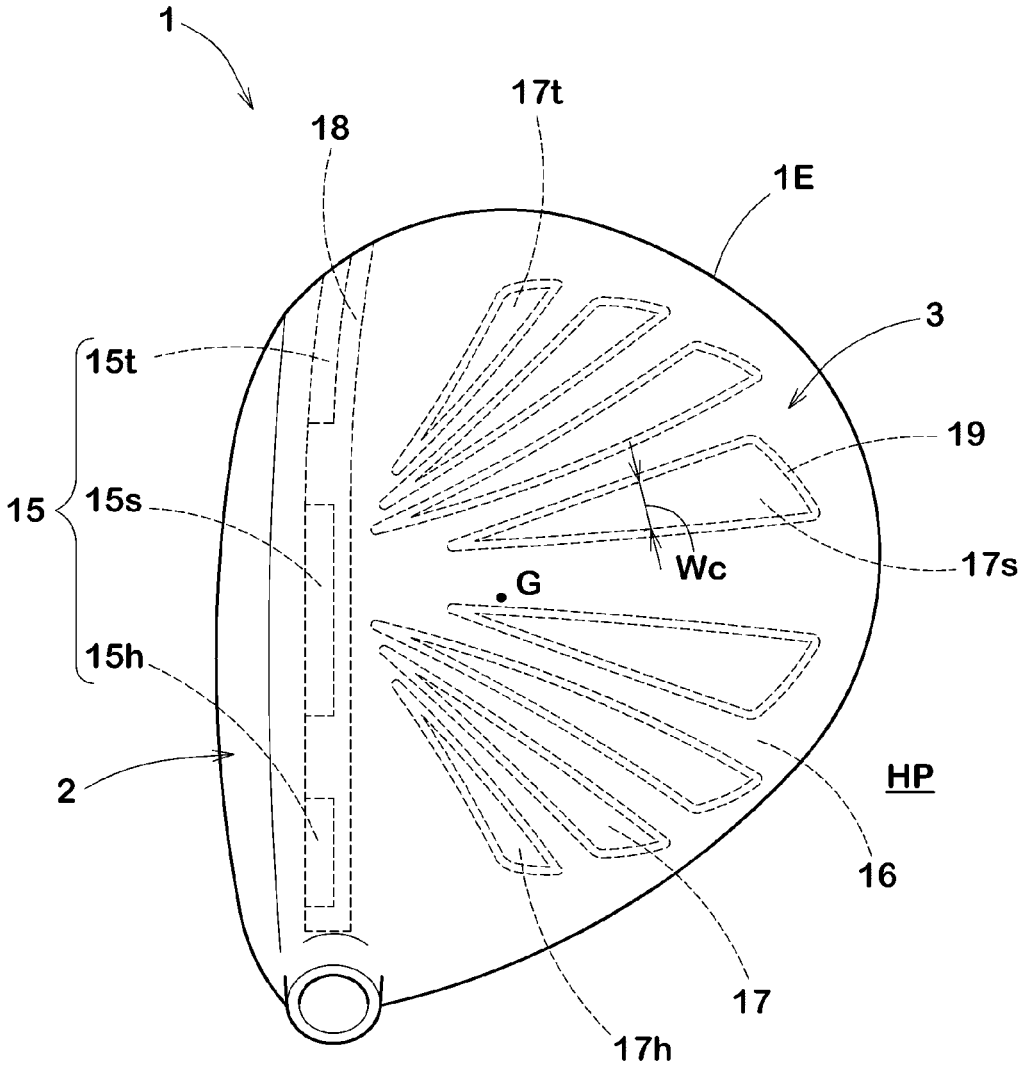

In the embodiment shown in FIG. 8, the third regions 17 include the most toe-side third region 17*t*, the most heel-side third region 17*h*, and six in-between third regions 17*s* therebetween.

In this embodiment, in comparison with the former embodiment, the third regions 17*t*, 17*h* and 17*s* are arranged over a wider range in the toe-heel direction, and the third regions having different sizes are increased in the number. Accordingly, the kinds of sound generated from the third regions are increased. In other words, the sound elements of the ball hitting sound are increased. Therefore, it becomes easy to control or change the ball hitting sound according to the user preference.

In the top view of the club head 1 under its standard state, all of the third regions 17 extend along respective directions radiating from a position in the vicinity of or slightly behind the sweet spot.

Preferably, the width We of each of the third regions 17*t*, 17*h* and 17*s* measured perpendicularly to the radial direction is gradually increased toward the radially outside.

In this embodiment, further, a plurality of the first regions 15 are disposed in the crown portion 3.

The first regions 15 include a toe-side first region 15*t*, a heel-side first region 15*h* and an in-between first region 15*s*. Accordingly, in comparison with the former embodiments provided with the first region 15 extending continuously between the toe-side end 15*a* at the toe-side end of the crown portion 3 and the heel-side end 15*b* near the hosel portion 6, it is possible to decrease the total mass of the first regions 15 to lower the position of the center of gravity of the head.

In the embodiments shown in FIGS. 7 and 8, the third regions 17 extend along respective directions radiating from the vicinity of a point substantially laid on the straight line N extending between the sweet spot SS and the center G of gravity in the top view of the club head 1 under its standard state.

Further, the third regions 17 can be arranged in the front-back direction FR along the straight line N.

Figure 9:
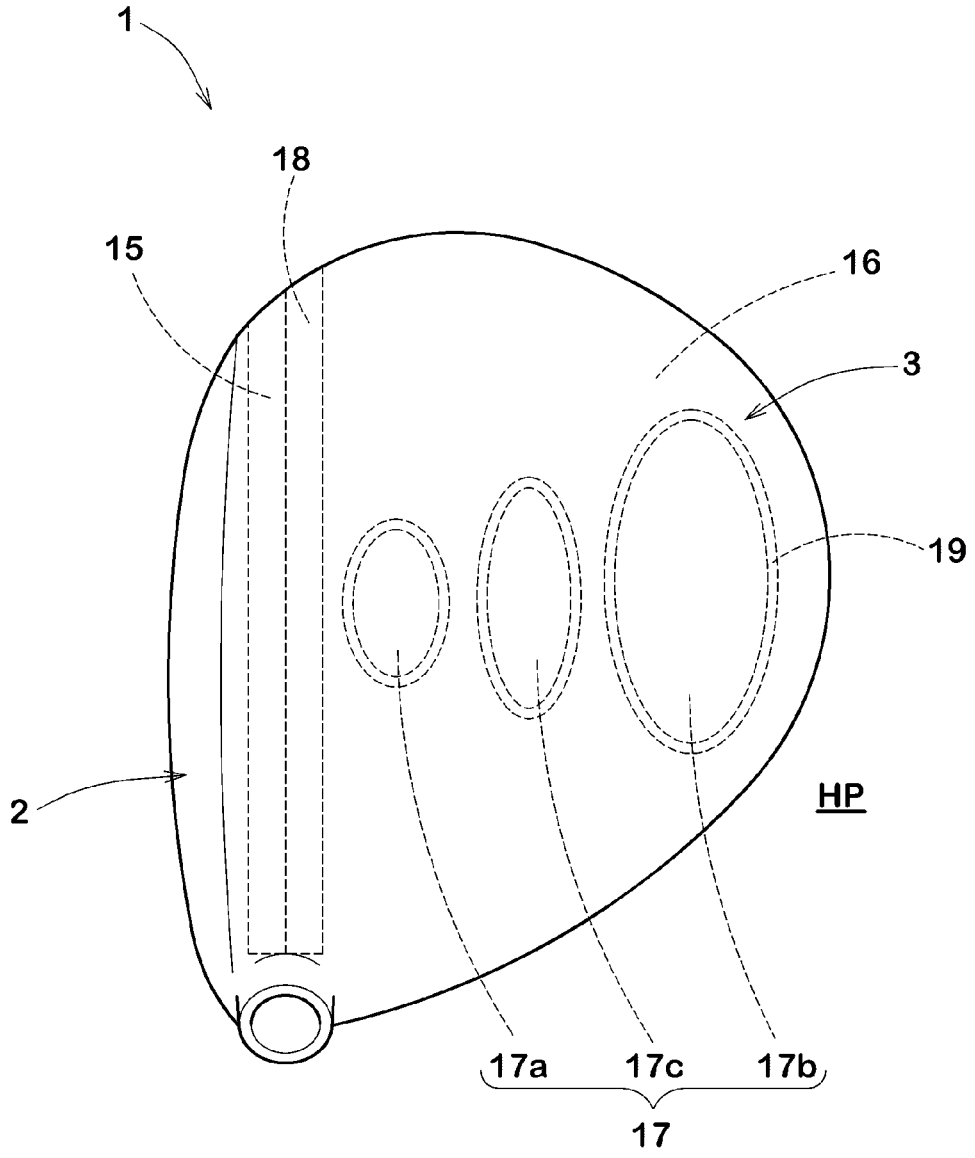

In the embodiment shown in FIG. 9, the third regions 17 include a front third region 17*a*, a rear third region 17*b* and a middle third region 17*c* therebetween.

In the top view of the club head 1 under its standard state, the areas of the front third region 17*a*, the middle third region 17*c* and rear third region 17*b* are gradually increased in this order. Accordingly, the frequency of sound generated from the third regions 17*a*, 17*c* and 7*b* is decreased from the front third region 17*a* to the rear third region 17*b*.

Therefore, the ball hitting sound smoothly changes from a high-pitched tone to a low-pitched tone with time.

Further, since the small third region 17*a* is disposed in a front part of the crown portion, the decrease in the rigidity of such front part is minimized, and the club head 1 is provided with good durability.

As a modification this embodiment, it is possible to gradually decrease the areas of the front third region 17*a*, the middle third region 17*c* and rear third region 17*b* in this order.

As another embodiment, a plurality of the front third regions 17*a* or a plurality of the rear third regions 17*b* may be disposed side-by-side in the toe-heel direction of the head, or a plurality of the middle third regions 17*c* may be disposed side-by-side in the toe-heel direction of the head or in the front-back direction.

Figure 10:
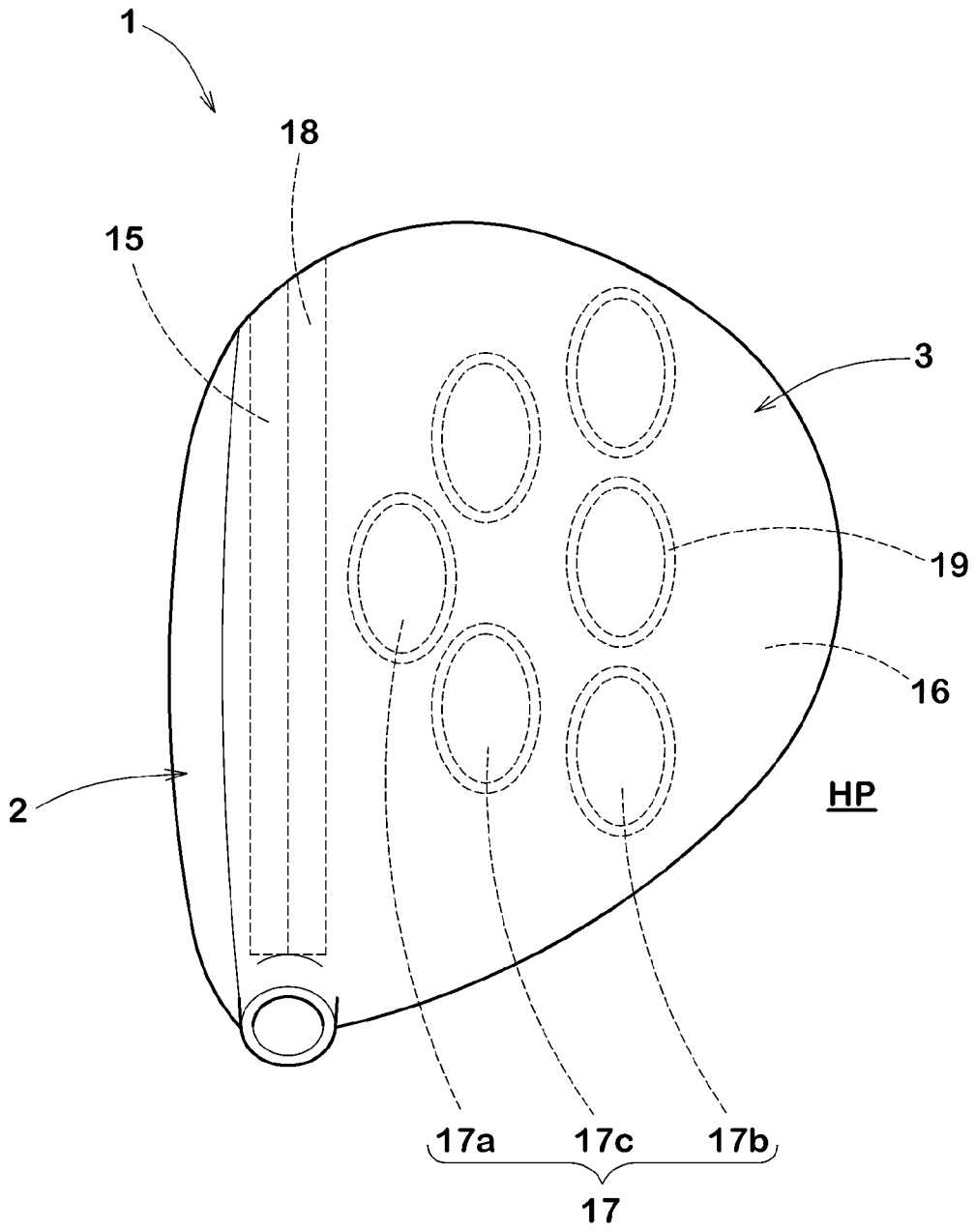

In the embodiment shown in FIG. 10, the third regions 17 include one front third region 17*a*, three rear third regions 17*b* arranged side-by-side in the toe-heel direction, and two middle third regions 17*c* arranged side-by-side in the toe-heel direction.

In this embodiment, all of the third regions 17*a*-17*c* have substantially same areas. Such arrangement can prevent the rigidity of the crown portion 3 from decreasing partially while achieving a large total area of the third regions 17.

While description has been made of preferable embodiments of the present invention, the illustrated embodiments should not be construed as to limit the scope of the present invention; various modifications are possible without departing from the scope of the present invention.

For example, the contour shape of the third region 17 can be a circle or a polygon aside from the oval and triangle.

Further, in the case of a plurality of the third regions 17, different kinds of shapes can be used in combination.

Comparison Tests

Figure 2:
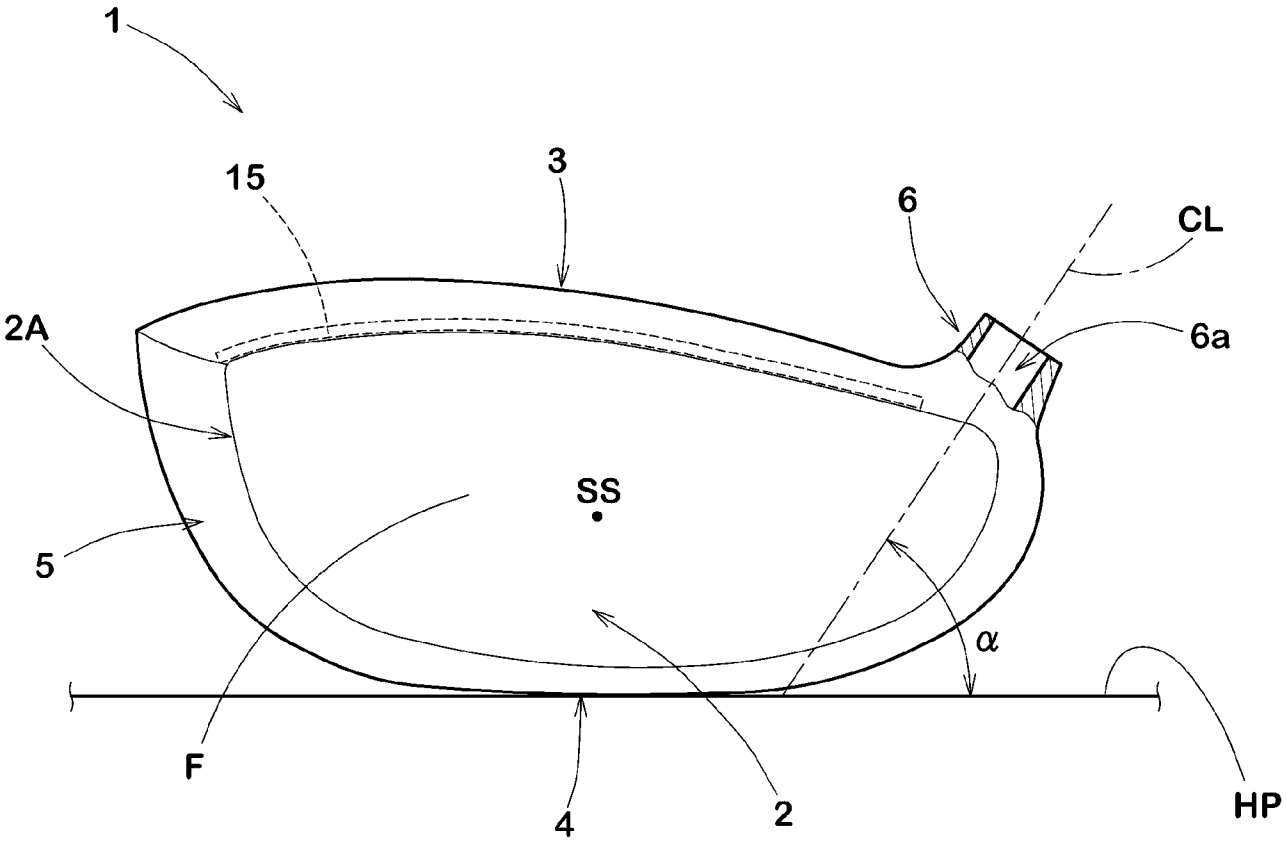
FIG. 2 is a front view thereof.

Based on the structure shown in FIGS. 1-3, club heads were experimentally manufactured. All of the club heads had the same specifications except for those shown in Table 1. The following specifications are common to all of the club heads.

lie angle: 58.0 degrees loft angle: 12.0 degrees club head mass: 194.0 grams head main body member material: Ti-8Al-1Mo-1V (titanium alloy)

face member material: TIX-51AF (titanium alloy manufactured by Nippon Steel & Sumitomo Metal corporation)

The club heads were measured for the frequency spectrum of the ball hitting sound and the reverberation time as follows.

<Frequency Spectrum of Ball Hitting Sound>

The club heads were attached to identical club shafts (Dunlop Sports co. Ltd., MP700, flex R) to make 45-inch wood-type golf clubs, and hit golf balls (Dunlop Sports co. Ltd., DDH TOURSPECIAL) by twenty golfers having handicaps of from 5 to 15. The ball hitting sound of each head was recorded by use of a noise meter. The recorded ball hitting sound was analyzed by use of a FFT analyzer (ONO SOKKI Co., Ltd., CF-4220) and a support software, and the frequency spectrum of the ball hitting sound was obtained. Then, the frequency of a distinctive peak of the frequency spectrum nearest to 4000 Hz was found. Such frequency is shown in Table 1 as the frequency of the ball hitting sound.

<Reverberation Time of Ball Hitting Sound>

The above-mentioned twenty golfers evaluated the reverberation time of the ball hitting sound of each club head into ten ranks, wherein the higher rank is the longer reverberation time, and the rank 5 is most preferable. Therefore, the closer the rank 5, the better the reverberation time. The results are shown in Table 1.

TABLE 1

| Head | Ref. | Ex. 1 | Ex. 2 | Ex. 3 | Ex. 4 | Ex. 5 | Ex. 6 |
|---|---|---|---|---|---|---|---|
| structure of crown portion (Fig. no.) | 1 | 1 | 1 | 1 | 1 | 1 | 1 |
| first region's area/Crown portion's area (%) | 0 | 20 | 5 | 8 | 30 | 35 | 20 |
| second region's area/Crown portion's area (%) | 0 | 50 | 65 | 52 | 43 | 40 | 60 |
| third region's area/Crown portion's area (%) | 0 | 15 | 15 | 15 | 12 | 10 | 5 |
| ball hitting sound | | | | | | | |
| frequency (Hz) | 2500 | 4000 | 3300 | 3500 | 4400 | 4600 | 4700 |
| reverberant sound | 9 | 5 | 8 | 7 | 4 | 3 | 3 |

| Head | Ex. 7 | Ex. 8 | Ex. 9 | Ex. 10 | Ex. 11 | Ex. 12 | Ex. 13 |
|---|---|---|---|---|---|---|---|
| structure of crown portion (Fig. no.) | 1 | 1 | 1 | 7 | 8 | 9 | 10 |
| first region's area/Crown portion's area (%) | 20 | 15 | 10 | 20 | 20 | 20 | 20 |
| second region's area/Crown portion's area (%) | 55 | 45 | 45 | 50 | 50 | 50 | 50 |
| third region's area/Crown portion's area (%) | 10 | 25 | 30 | 15 | 15 | 15 | 15 |
| ball hitting sound | | | | | | | |
| frequency (Hz) | 4100 | 3800 | 3200 | 4100 | 4200 | 3800 | 3900 |
| reverberant sound | 4.5 | 6 | 9 | 4 | 3.5 | 6 | 5.5 |

Through the ball hitting test, it was confirmed by the golfers that the club heads according to the present invention were improved in the ball hitting sound.

The invention claimed is:

1. A golf club head with a hollow therein, said golf club head comprising: a face portion having a club face for hitting a ball, and a crown portion extending from the face portion to form a top surface of the club head, wherein the crown portion provided with a first region having a first thickness, a second region having a second thickness less than the first thickness, and a plurality of third regions having a third thickness less than the second thickness, wherein the first region is disposed in a face portion side of the crown portion and extends in the toe-heel direction, the third regions are disposed backward of the first region, and the second region surrounds the third regions, and wherein, in a top view of the club head in its standard state, said third regions extend along respective directions radiating from the vicinity of a point substantially on a straight line extending between a sweet spot and a center of gravity of the head while gradually increasing their widths measured perpendicularly to the respective radial directions, and at least three of the third regions are disposed on the heel side of the center of gravity of the head and at least three of the third regions are disposed on the toe side of the center of gravity of the head.

2. The golf club head according to claim 1, wherein in the top view of the golf club head under its standard state, the area of the first region is 8% to 30% of the area of the crown portion.

3. The golf club head according to claim 1, wherein in the top view of the golf club head under its standard state, the area of the second region is 40% to 80% of the area of the crown portion.

4. The golf club head according to claim 1, wherein in the top view of the golf club head under its standard state, the area of the third region is 10% to 25% of the area of the crown portion.

5. The golf club head according to claim 1, wherein the first thickness is 0.6 to 1.7 mm, the second thickness is 0.5 to 0.9 mm and the third thickness is 0.3 to 0.6 mm.

6. The golf club head according to claim 1, wherein the first thickness is constant, the second thickness is constant, and a 1st transitional zone of which thickness is gradually decreased from the first region to the second region is formed between the first region and the second region.

7. The golf club head according to claim 1, wherein the second thickness is constant, the third thickness is constant, and a 2nd transitional zone of which thickness is gradually decreased from the second region to the third region is formed between the second region and the third region.

8. The golf club head according to claim 1, wherein four of the third regions are disposed on the heel side of the center of gravity of the head, and four of the third regions are disposed on the toe side of the center of gravity of the head.

9. The golf club head according to claim 1, wherein the first thickness is constant, the second thickness is constant, the third thickness is constant, a first transitional zone of which thickness is gradually decreased from the first region to the second region is formed between the first region and the second region, and a second transitional zone of which thickness is gradually decreased from the second region to the third region is formed between the second region and each of the third regions.

* * * * *